US007414366B2

(12) United States Patent
Perez et al.

(10) Patent No.: US 7,414,366 B2
(45) Date of Patent: Aug. 19, 2008

(54) SINGLE-ENDED DISCHARGE VESSEL WITH DIVERGING ELECTRODES

(75) Inventors: Victor E. Perez, Manchester, NH (US); Jeffrey T. Neil, North Reading, MA (US); Gregory Zaslavsky, Marblehead, MA (US)

(73) Assignee: Osram Sylvania Inc., Danvers, MA (US)

( * ) Notice: Subject to any disclaimer, the term of this patent is extended or adjusted under 35 U.S.C. 154(b) by 483 days.

(21) Appl. No.: 11/160,331

(22) Filed: Jun. 20, 2005

(65) Prior Publication Data

US 2005/0212433 A1 Sep. 29, 2005

(51) Int. Cl.
*H01J 17/02* (2006.01)
*H01J 61/04* (2006.01)

(52) U.S. Cl. ..... 313/621; 313/620; 313/574; 313/631

(58) Field of Classification Search ..... 313/623, 313/634, 574, 631, 620, 621
See application file for complete search history.

(56) References Cited

U.S. PATENT DOCUMENTS 3,900,237 A * 8/1975 Marcucci ..... 445/26
4,056,751 A * 11/1977 Gungle et al. ..... 313/634
4,482,842 A * 11/1984 Fujimura et al. ..... 313/634
4,498,027 A * 2/1985 Karlotski et al. ..... 313/634
4,724,361 A * 2/1988 Wada et al. ..... 315/246
4,912,364 A * 3/1990 Hollo et al. ..... 313/623
5,539,271 A * 7/1996 Sulcs et al. ..... 313/25
5,936,351 A * 8/1999 Lang ..... 313/634
6,620,272 B2 9/2003 Zaslasky et al. ..... 156/73.5
2003/0116892 A1* 6/2003 Horibe ..... 264/635

FOREIGN PATENT DOCUMENTS

DE 3713371 11/1987
EP 0438060 7/1991
EP 0877412 11/1998
EP 1 111 654 A1 6/2001
GB 2191337 12/1987
RU 2000628 C * 9/1993

* cited by examiner

*Primary Examiner*—Mariceli Santiago
(74) *Attorney, Agent, or Firm*—Robert F. Clark

(57) ABSTRACT

A ceramic discharge vessel for a high-intensity discharge lamp includes a hollow body and two capillaries attached to the body. The capillaries have respective electrodes therein, where portions of the electrodes inside the body are spaced from each other and have longitudinal axes that are not coplanar. That is, in contrast to the prior art where the longitudinal axes are coplanar, the capillaries herein are moved (in effect, rotated) to positions in which a first plane defined by a longitudinal axis of one capillary and a first point where a second capillary is attached to the body is intersected by a longitudinal axis of the second capillary only at the first point.

15 Claims, 1 Drawing Sheet

SINGLE-ENDED DISCHARGE VESSEL WITH DIVERGING ELECTRODES

BACKGROUND OF THE INVENTION

The present invention is directed to a ceramic discharge vessel for a high-intensity discharge lamp, and more particularly to a single-ended discharge vessel with electrodes that diverge from each other so that a discharge arc is confined to tips of the electrodes.

FIG. 1 is a cross-sectional illustration of a single-ended discharge vessel of the prior art. The discharge vessel 10 includes a ceramic body 12, two capillaries 14 extending from a same side of body 12 (e.g., extending from a common hemisphere), and two electrodes 16 that are each in a different one of the two capillaries 14. The longitudinal axes of the capillaries 14 and the electrodes 16 are all in a common plane of the drawing sheet. European Patent Application 1 111 654 describes discharge vessels of this type. Capillaries 14 and electrodes 16 extend from the same side of body 12 to reduce the overall size of the discharge vessel compared to double-ended discharge vessels that have two capillaries that extend collinearly from opposite sides of the body.

One of the problems with this side-by-side arrangement of electrodes is that an arc discharge between the electrodes can walk down the electrodes toward the wall of the discharge vessel and damage the ceramic. To discourage this, the electrodes are angled apart so that they diverge from each other thereby making the tips of the electrodes the closest two points between the electrodes inside the discharge vessel. The electrodes 16 in FIG. 1 diverge from each other within the common plane to attempt to confine the arc discharge between electrodes 16 to electrode tips 18.

The amount of divergence of electrodes 16 from each other can be confined to a relatively small angular range (up to about 12°) in discharge vessels in which the distal ends of capillaries 14 do not project beyond an edge of body 12, as illustrated by the dashed lines E in FIG. 1. It would be desirable to increase this angular range while keeping the distal ends of capillaries 14 confined within the edge of body 12.

Further, it would be desirable to offer an attractive alternative arrangement of the capillaries to create an additional option for reducing the overall size of the discharge vessel.

SUMMARY OF THE INVENTION

An object of the present invention is to provide a novel ceramic discharge vessel for a lamp in which the electrodes diverge from each other.

A further object of the present invention is to provide a novel ceramic discharge vessel with a hollow body, and two capillaries having respective electrodes therein, where portions of the electrodes inside the body are spaced from each other and have longitudinal axes that are not coplanar.

A yet further object of the present invention is to provide a novel ceramic discharge vessel with a body and two hollow capillaries, wherein a longitudinal axis of one capillary and a point where the second capillary is attached to the body define a plane, and wherein a longitudinal axis of the second capillary intersects this plane only at the point.

These and other objects and advantages of the invention will be apparent to those of skill in the art of the present invention after consideration of the following drawings and description of preferred embodiments.

DESCRIPTION OF PREFERRED EMBODIMENTS

Figure 2:
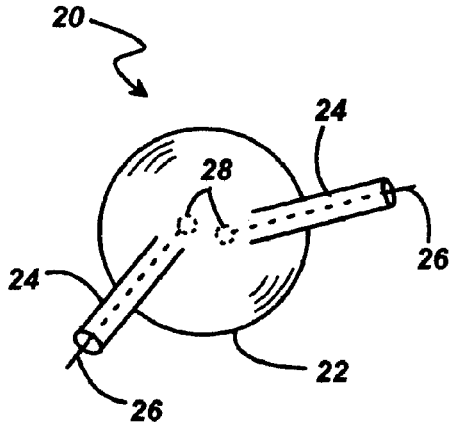
FIG. 2 is a pictorial representation of an embodiment of a ceramic discharge vessel of the present invention.

With reference now to FIG. 2, an embodiment of the present invention is a ceramic discharge vessel 20 with a hollow body 22 and two capillaries 24 that are not in the same plane. Preferably, the body and capillaries are comprised of polycrystalline alumina (PCA). Each capillary 24 carries an electrode 26 whose electrode tip 28 is inside body 22. The electrode tips 28 are separated from each other to create a gap for an arc discharge. Note that the respective portions of electrodes 26 that are inside body 22 have longitudinal axes that are not coplanar.

Preferably, the electrodes are comprised of multiple metal and/or cermet sections. In particular, it is desirable to have a feedthrough section comprised of niobium because of its favorable coefficient of thermal expansion with regard to the commonly used polycrystalline alumina ceramic. The feedthrough section is sealed hermetically to its respective capillary with a frit material, e.g., $Al_2O_3$—$SiO_2$—$Dy_2O_3$. The portion of the electrode protruding into the body of the discharge vessel is preferably comprised of a tungsten shaft with a tungsten coil attached to its end to serve as the electrode tip and point of arc attachment. For ceramic metal halide lamps, the discharge vessel is filled with a mixture of metal halide salts and may include mercury. For example, a typical metal halide fill material may comprise mercury plus some combination of NaI, $CaI_2$, $DyI_3$, $HoI_3$, $TmI_3$, and TlI. The discharge vessel will also contain a buffer gas, e.g., 30 to 300 torr Xe or Ar.

Figure 1:
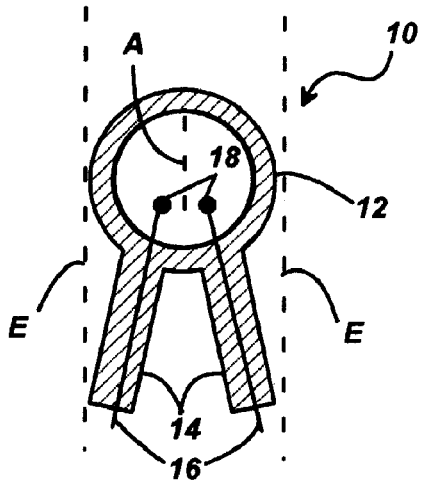
Fig. 1 (Prior Art)
FIG. 1 is a cross sectional representation of a discharge vessel of the prior art.

An understanding of the arrangement of capillaries 24 in discharge vessel 20 may be enhanced by again referring to FIG. 1 and visualizing that part of body 12 and one capillary 14 in discharge vessel 10 has been "rotated" (e.g., about line A in FIG. 1) so that the rotated capillary is out of the plane of the drawing sheet.

Figure 3A:
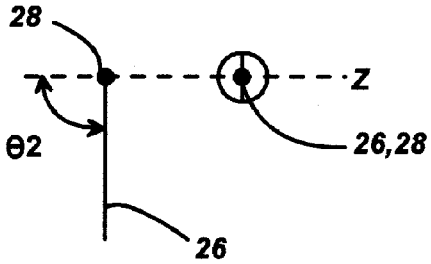
FIGS. 3A and 3B are side and end diagrams illustrating a relationship between longitudinal axes of the capillaries and a Z axis defined by the electrode tips.
Figure 3B:
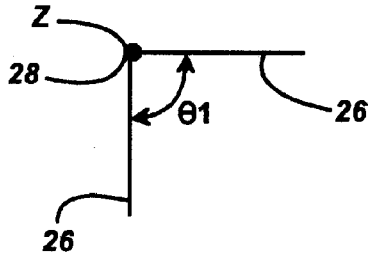

This may be more clearly seen in FIGS. 3*a,b* in which the electrodes 26 and their respective electrode tips 28 are shown diagrammatically. The electrode tips 28 define an imaginary Z axis (two points define a line) from which the longitudinal axes of electrodes 26 extend. The amount of "rotation" is illustrated in FIG. 3*b* as angle θ1 between the longitudinal axes when viewed down the Z axis. As is apparent, a longitudinal axis of one electrode and the Z axis define a first plane that is different from a second plane defined by a longitudinal axis of the other electrode and the Z axis.

When one considers the geometry of the discharge vessel 20 of FIG. 2 and the diagram of FIG. 3*b*, it is apparent that the angle at which electrodes 26 diverge from each other is determined by the amount of "rotation" of the one capillary. A rotation (angle θ1) of greater than zero degrees will cause the electrodes to diverge from each other, and a rotation of 3° or greater is preferred. A rotation up to and beyond 90° is certainly feasible, although overall discharge vessel size and/or compatibility with present lamp structures may be factors that suggest an upper limit for the rotation. Further, as discussed below a method of making the discharge vessel may influence the selection of a rotation amount.

The capillaries 24 and their respective electrodes 26 diverge from each other so as to avoid the problem of the arc discharge walking down the electrodes and damaging the ceramic of the body. The divergence is achieved regardless of whether the capillaries and electrodes are given a further inclination. With reference again to FIG. 3*a*, the angle θ2 represents this further inclination of the capillaries. Angle θ2 may be an acute angle to achieve the capillaries with compound angles shown in FIG. 2, or may be 90° so that both longitudinal axes of the electrodes 26 are perpendicular to the Z axis and to each other.

Figure 4:
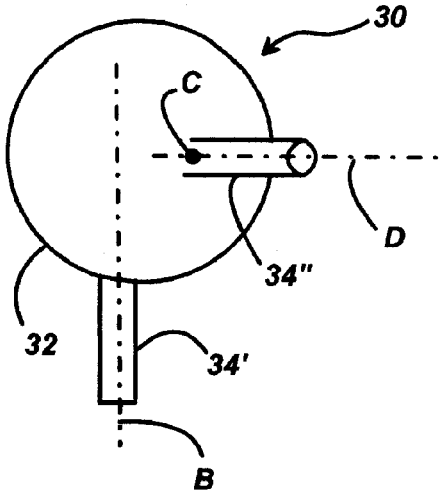
FIG. 4 is a pictorial representation of a further embodiment of a ceramic discharge vessel of the present invention.

FIG. 4 presents a further way of describing the present invention. The discharge vessel 30 includes a body 32 and first and second hollow capillaries 34', 34" attached to body 32. A longitudinal axis B of first capillary 34' and a point C where second capillary 34" is attached to body 32 define a plane (a line and a point define a plane), and a longitudinal axis D of second capillary 34" intersects this plane only at point C.

The discharge vessel of the present invention may be made using conventional methods, such as the one described in U.S. Pat. No. 6,620,272, which is incorporated by reference. This patent describes a method for assembling a ceramic body in which two ceramic halves are joined together. The surfaces to be joined are heated to cause localized melting and then brought together and joined at a seam by alternately compressing and stretching the seam. The body parts are held in place with retractable pins.

Figure 5:
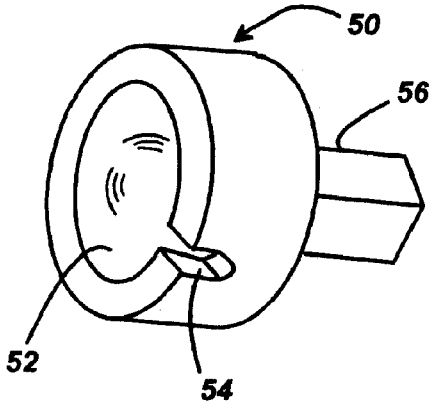
FIG. 5 is a pictorial representation of an embodiment of a fixture for holding a ceramic discharge vessel part during assembly.

Other devices may not use this technique and for such devices an alternative approach may be used. The body may be provided in two parts that are to be joined, such as along line A in FIG. 1. Each of the two parts is held in a fixture 50 shown in FIG. 5 that is shaped at 52 to receive the part of the body (e.g., semicircular) and have a slot 54 in which a capillary is held. The placement of the capillary in slot 54 prevents rotation of the body part relative to the fixture 50. The fixture 50 is held in a clamp that is movable relative to another clamp and fixture so that two parts of a discharge vessel may be aligned, brought together and joined conventionally.

The fixture 50 is held in the clamp at a projection 56 that extends from a rear of the fixture. The projection 56 may be polygonal and held in correspondingly configured clamp to set the angle θ1 (FIG. 3*b*) between the longitudinal axes of the electrodes. One clamp and one fixture are fixed in position and the other fixture in the other clamp is rotated in the clamp (rotation being relative to the one fixture) to achieve angle θ1. For example, if the projection 56 is square, then the other fixture can be rotated so that angle θ1 may be 0°, 90°, 180° or 270°. Other angles are possible with other polygons (for example, a six sided projection sets angle θ1 in 60° increments and an eight sided projection sets angle θ1 in 45° increments). The polygon projection makes the process for setting the desired angle θ1 repeatable and accurate.

While embodiments of the present invention have been described in the foregoing specification and drawings, it is to be understood that the present invention is defined by the following claims when read in light of the specification and drawings.

What is claimed is:

1. A ceramic discharge vessel for a lamp, comprising:

a hollow body; and two capillaries attached to said body and having respective electrodes therein, wherein respective portions of said electrodes inside said body are spaced from each other and have longitudinal axes that are not coplanar.

2. The discharge vessel of claim 1, wherein said electrodes have tips inside said body that together define a Z axis, and wherein a plane containing one of the longitudinal axes and said Z axis intersects a plane containing the other of the longitudinal axes and said Z axis at an angle in a range of greater than 0° to 90°.

3. The discharge vessel of claim 2, wherein the range is 3° to 90°.

4. The discharge vessel of claim 1, wherein said electrodes have tips inside said body that together define a Z axis, and wherein said two capillaries have respective longitudinal axes that are each perpendicular to the Z axis.

5. The discharge vessel of claim 1, wherein said electrodes have tips inside said body that together define a Z axis, and wherein said two capillaries have respective longitudinal axes that each makes a respective acute angle with the Z axis.

6. A ceramic discharge vessel for a lamp, comprising:

a hollow body;

a first hollow capillary attached to said body; and a second hollow capillary attached to said body and spaced from said first capillary, wherein a longitudinal axis of said first capillary and a point where said second capillary is attached to said body define a plane, and wherein a longitudinal axis of said second capillary intersects said plane only at said point.

7. The discharge vessel of claim 6, wherein said body has a central axis, and wherein a plane containing one of the longitudinal axes and said central axis intersects a plane containing the other of the longitudinal axes and said central axis at an angle in a range of greater than 0° to 90°.

8. The discharge vessel of claim 7, wherein the range is 3° to 90°.

9. The discharge vessel of claim 6, wherein said body has a central axis, and wherein said two capillaries have respective longitudinal axes that are each perpendicular to the central axis.

10. The discharge vessel of claim 6, wherein said body has a central axis, and wherein said two capillaries have respective longitudinal axes that each makes a respective acute angle with the central axis.

11. A ceramic discharge vessel for a lamp, comprising:

a hollow body;

a first capillary attached to said body and having a first electrode therein;

a second capillary attached to said body and having a second electrode therein, said first and second electrodes having respective electrode tips inside said body that together define a Z axis, wherein a longitudinal axis of said first electrode and said Z axis define a first plane that is different from a second plane defined by a longitudinal axis of said second electrode and said Z axis.

12. The discharge vessel of claim 11, wherein said first plane intersects said second plane at an angle in a range of greater than 0° to 90°.

13. The discharge vessel of claim 12, wherein the range is 3° to 90°.

14. The discharge vessel of claim 11, wherein said first and second capillaries have respective longitudinal axes that are each perpendicular to said Z axis.

15. The discharge vessel of claim 11, wherein said first and second capillaries have respective longitudinal axes that each makes a respective acute angle with said Z axis.

* * * * *